US008490400B2

(12) United States Patent
Koenig et al.

(10) Patent No.: US 8,490,400 B2
(45) Date of Patent: Jul. 23, 2013

(54) COMBUSTOR ASSEMBLY COMPRISING A COMBUSTOR DEVICE, A TRANSITION DUCT AND A FLOW CONDITIONER

(75) Inventors: Michael H. Koenig, Oviedo, FL (US); William R. Ryan, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1018 days.

(21) Appl. No.: 12/210,363

(22) Filed: Sep. 15, 2008

(65) Prior Publication Data

US 2010/0064693 A1 Mar. 18, 2010

(51) Int. Cl.
*F02C 1/00* (2006.01)

(52) U.S. Cl.
USPC ..... 60/755; 60/752

(58) Field of Classification Search
USPC ..... 60/752–760
See application file for complete search history.

(56) References Cited

U.S. PATENT DOCUMENTS

| | | | | |
|---|---|---|---|---|
| 2,510,645 | A | 6/1950 | McMahan | |
| 3,589,128 | A | 6/1971 | Sweet | |
| 3,899,882 | A | 8/1975 | Parker | |
| 4,192,138 | A | 3/1980 | Szema | |
| 4,339,925 | A | 7/1982 | Eggmann et al. | |
| 4,719,748 | A | 1/1988 | Davis, Jr. et al. | |
| 5,050,385 | A | 9/1991 | Hirose et al. | |
| 5,309,710 | A | 5/1994 | Corr, II | |
| 5,474,306 | A * | 12/1995 | Bagepalli et al. | 277/355 |
| 5,557,920 | A * | 9/1996 | Kain | 60/39.23 |
| 5,724,816 | A | 3/1998 | Ritter et al. | |
| 5,737,915 | A | 4/1998 | Lin et al. | |
| 5,758,504 | A | 6/1998 | Abreu et al. | |
| 6,134,877 | A | 10/2000 | Alkabie | |
| 6,460,345 | B1 | 10/2002 | Beebe et al. | |
| 6,494,044 | B1 | 12/2002 | Bland | |
| 6,832,481 | B2 | 12/2004 | Koenig et al. | |
| 7,197,803 | B2 | 4/2007 | Kemsley et al. | |
| 7,249,461 | B2 | 7/2007 | Moraes | |
| 7,284,378 | B2 | 10/2007 | Amond, III et al. | |
| 7,377,116 | B2 | 5/2008 | Parker et al. | |
| 2001/0032453 | A1 * | 10/2001 | Tatsumi et al. | 60/39.31 |
| 2001/0052229 | A1 | 12/2001 | Tuthill et al. | |
| 2006/0101801 | A1 | 5/2006 | Bland | |
| 2007/0130958 | A1 | 6/2007 | Ohri et al. | |
| 2008/0053107 | A1 * | 3/2008 | Weaver et al. | 60/800 |
| 2009/0139238 | A1 * | 6/2009 | Martling et al. | 60/740 |

FOREIGN PATENT DOCUMENTS

| | | | |
|---|---|---|---|
| EP | 0660046 | A1 | 6/1995 |
| EP | 1148300 | A1 | 10/2001 |
| EP | 1510760 | A1 | 3/2005 |
| EP | 1 843 097 | A1 | 10/2007 |
| JP | 55-164731 | | 12/1980 |
| JP | 03-001015 | | 1/1991 |
| WO | 2007053323 | A2 | 5/2007 |

* cited by examiner

*Primary Examiner* — Gerald Sung

(57) ABSTRACT

A combustor assembly in a gas turbine engine is provided. The combustor assembly may comprise a combustor device coupled to a main casing, a transition duct and a flow conditioner. The combustor device may comprise a liner having inlet and outlet portions and a burner assembly positioned adjacent to the liner inlet. The transition duct may comprise a conduit having inlet and outlet sections. The inlet section may be associated with the liner outlet portion. The flow conditioner may be associated with the main casing and the transition duct conduit for supporting the conduit inlet section.

15 Claims, 6 Drawing Sheets

COMBUSTOR ASSEMBLY COMPRISING A COMBUSTOR DEVICE, A TRANSITION DUCT AND A FLOW CONDITIONER

FIELD OF THE INVENTION

The present invention relates to a combustor assembly comprising a combustor device, a transition duct and a flow conditioner and, more preferably, to such a combustor assembly having a flow conditioner that functions to support an inlet section of a transition duct conduit.

BACKGROUND OF THE INVENTION

A conventional combustible gas turbine engine includes a compressor, a combustor, including a plurality of combustor assemblies, and a turbine. The compressor compresses ambient air. The combustor assemblies comprise combustor devices that combine the compressed air with a fuel and ignite the mixture creating combustion products defining a working gas. The working gases are routed to the turbine inside a plurality of transition ducts. Within the turbine are a series of rows of stationary vanes and rotating blades. The rotating blades are coupled to a shaft and disc assembly. As the working gases expand through the turbine, the working gases cause the blades, and therefore the disc assembly, to rotate.

Each transition duct may comprise a generally tubular main body or conduit having an inlet section which is fitted over an outlet portion of a liner of a corresponding combustor device. The liner outlet portion may include radially contoured spring clips, see for example, FIG. 1D in U.S. Pat. No. 7,377,116, to accommodate relative motion between the liner outlet portion and the transition duct conduit inlet section, which may occur during gas turbine engine operation. Further, a support bracket may be coupled to a main casing of the gas turbine engine and the transition duct conduit inlet section so as to support the transition duct conduit inlet section, see for example, FIG. 5 in U.S. Pat. No. 7,197,803.

SUMMARY OF THE INVENTION

In accordance with a first aspect of the present invention, a combustor assembly in a gas turbine engine comprising a main casing is provided. The combustor assembly may comprise a combustor device coupled to the main casing, a transition duct and a flow conditioner. The combustor device may comprise a liner having inlet and outlet portions and a burner assembly positioned adjacent to the liner inlet portion. The transition duct may comprise a conduit having inlet and outlet sections. The inlet section may be associated with the liner outlet portion. The flow conditioner may be associated with the main casing and the transition duct conduit for supporting the conduit inlet section.

The flow conditioner conditions compressed air moving toward the burner assembly to achieve a more uniform air distribution at the burner assembly.

The flow conditioner may comprise a perforated sleeve having first and second ends. The first end may be fixedly coupled to the main casing. The sleeve second end and the transition duct conduit inlet section may be movable relative to one another.

The flow conditioner may further comprise a roller bearing coupled to the sleeve second end for engaging an outer surface of the transition duct conduit inlet section.

An inner surface of the sleeve second end and an outer surface of the transition duct conduit inlet section may be provided with a wear resistant coating to allow the inner and outer surfaces to move smoothly relative to one another and prevent wear of the inner and outer surfaces.

The flow conditioner preferably provides sufficient support for the conduit inlet section such that a separate support bracket extending between the main casing and the conduit inlet section is not provided.

The liner outlet portion may not comprise radially contoured spring clips.

A floating ring may be provided in a slot formed in an inner surface of the transition duct inlet section.

A brush seal may be associated with an inner surface of the transition duct inlet section.

In accordance with a second aspect of the present invention, a combustor assembly in a gas turbine engine comprising a main casing is provided. The combustor assembly may comprise a combustor device, a transition duct and a flow conditioner. The combustor device may comprise a liner having inlet and outlet portions and a burner assembly positioned adjacent the liner inlet portion. The transition duct may comprise a conduit having inlet and outlet sections. The inlet section may be associated with the liner outlet portion. The liner outlet portion is preferably devoid of radially contoured spring clips. The flow conditioner may be associated with the main casing and the transition duct conduit for supporting the conduit inlet section.

DETAILED DESCRIPTION OF THE INVENTION

Figure 1:
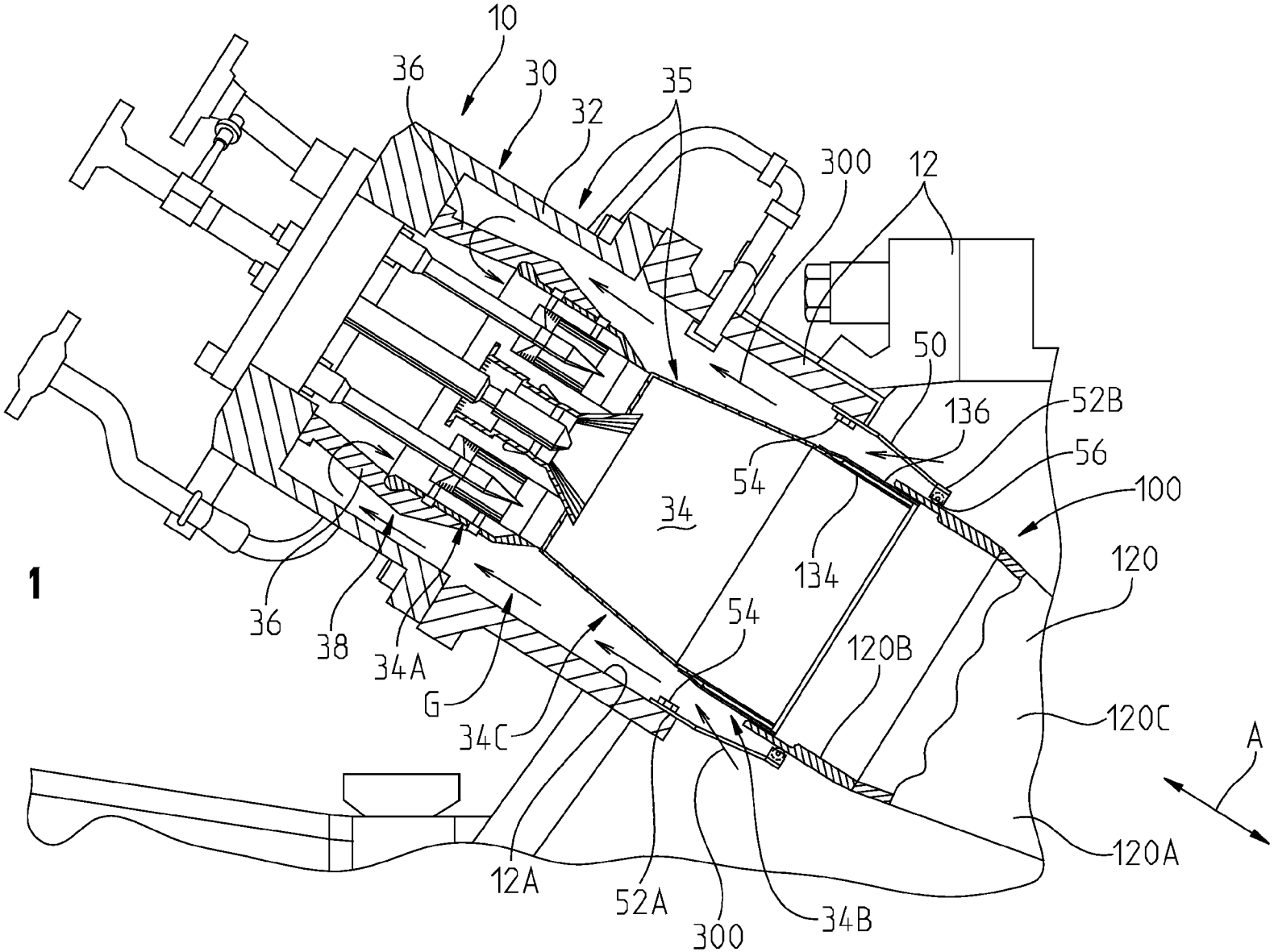
FIG. 1 is a side view, partially in cross section, of a combustor assembly constructed in accordance with one embodiment of the present invention.

A portion of a can-annular combustion system 10, constructed in accordance with the present invention, is illustrated in FIG. 1. The combustion system 10 forms part of a gas turbine engine. The gas turbine engine further comprises a compressor (not shown) and a turbine (not shown). Air enters the compressor, where it is compressed to elevated pressure and delivered to the combustion system 10, where the compressed air is mixed with fuel and burned to create hot combustion products defining a working gas. The working gases are routed from the combustion system 10 to the turbine. The working gases expand in the turbine and cause blades coupled to a shaft and disc assembly to rotate.

The can-annular combustion system 10 comprises a plurality of combustor assemblies 100. Each assembly 100 comprises a combustor device 30, a corresponding transition duct 120 and a flow conditioner 50. The combustor assemblies 100 are spaced circumferentially apart and coupled to an outer shell or casing 12 of the gas turbine engine. Each transition duct 120 receives combustion products from its corresponding combustor device 30 and defines a path for those combustion products to flow from the combustor device 30 to the turbine.

Only a single combustor assembly 100 is illustrated in FIG. 1. Each assembly 100 forming part of the can-annular combustion system 10 may be constructed in the same manner as the combustor assembly 100 illustrated in FIG. 1. Hence, only the combustor assembly 100 illustrated in FIG. 1 will be discussed in detail here.

The combustor device 30 of the assembly 100 in the illustrated embodiment comprises a combustor casing 32, shown in FIG. 1, coupled to the outer casing 12 of the gas turbine engine. The combustor device 30 further comprises a liner 34 and a burner assembly 38, see FIG. 1. The liner 34 is coupled to the combustor casing 32 via support members 36. The burner assembly 38 is coupled to the combustor casing 32 and functions to inject fuel into the compressed air such that it mixes with the compressed air. The air and fuel mixture burns in the liner 34 and corresponding transition duct 120 so as to create hot combustion products. In the illustrated embodiment, the combustor casing 32 and liner 34 define a combustor structure 35. Alternatively, the combustor structure may comprise a liner coupled directly to the outer casing 12. In this alternative embodiment, the burner assembly may also be coupled directly to the outer casing 12.

Figure 5:
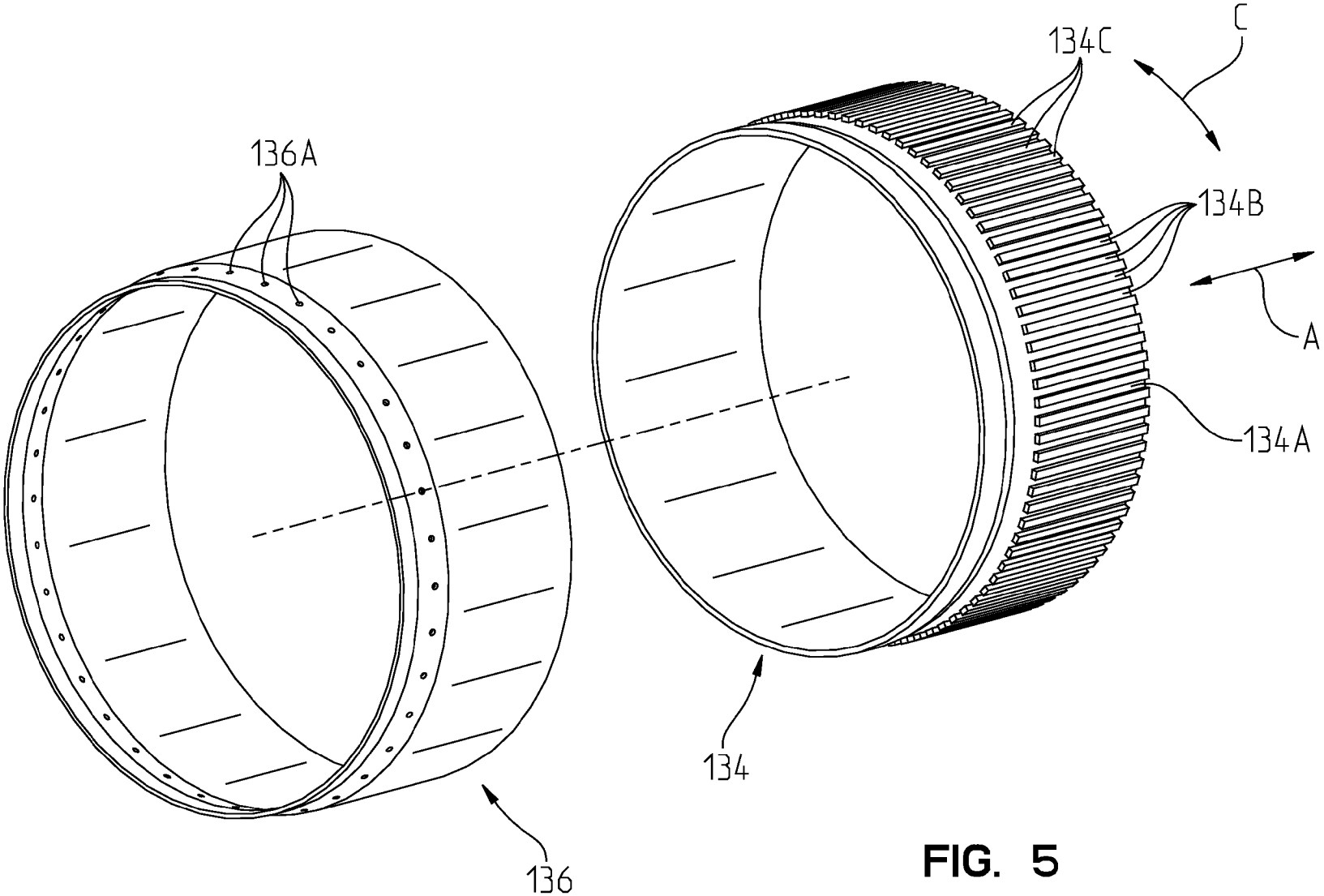
FIG. 5 is an exploded perspective view of inner and outer parts of an outlet portion of the liner of the combustor assembly illustrated in FIG. 1.

In the illustrated embodiment, the liner 34 comprises a closed curvilinear liner comprising an inlet portion 34A, an outlet portion 34B, and a generally cylindrical intermediate body 34C, see FIG. 1. The outlet portion 34B is defined by an inner exit part 134 and an outer exit part 136, see FIGS. 1, 2 and 5. The inner exit part 134 is provided on its outer surface 134A with a plurality of small grooves 134B defined between ribs 134C, see FIG. 5. The grooves 134B extend in an axial direction and are spaced apart from one another in a circumferential direction, see FIGS. 1 and 5. In FIG. 5, the axial direction is designated by arrow A and the circumferential direction is designated by arrow C. The outer exit part 136 is positioned about and fixedly coupled to the inner exit part 134, such as by welding. The inner exit part 134 is integral with the intermediate body 34C. The outer exit part 136 comprises a plurality of cooling openings 136A, which openings 136A are spaced apart from one another in the circumferential direction. The openings 136A communicate with the grooves 134B in the inner exit part 134. The number of openings 136A may be less than, equal to or greater than the number of grooves 134B provided in the inner exit part 134. The grooves 134B in the inner exit part 134 and adjacent inner surface portions 136C of the outer exit part 136 define cooling channels 138, see FIG. 2. Compressed air from the compressor passes into the openings 136A and through the cooling channels 138 so as to cool the inner and outer exit parts 134 and 136. The liner 34 may be formed from a high-temperature capable material, such as Hastelloy-X.

The transition duct 120 may comprise a conduit 120A having a generally cylindrical inlet section 120B, a main body section 120C, and a generally rectangular outlet section (not shown). A collar (not shown) is coupled to the conduit outlet section. The conduit 120A and collar may be formed from a high-temperature capable material such as Hastelloy-X, Inconel 617 or Haynes 230. The conduit inlet section 120B may have a thickness of from about 0.4 inch to about 0.7 inch. The collar is adapted to be coupled to a row 1 vane segment (not shown).

Figure 2:
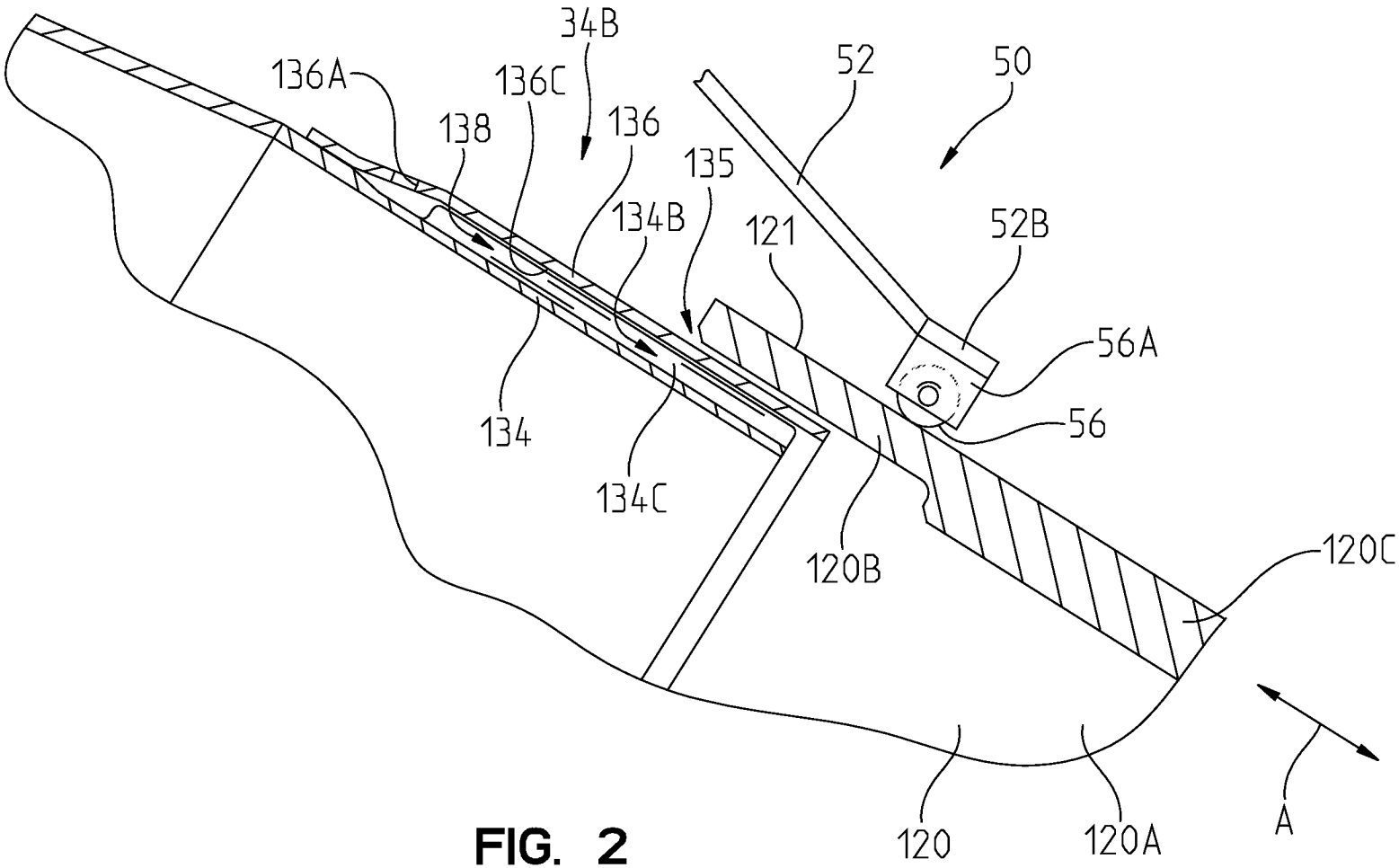
FIG. 2 is an enlarged cross sectional view of a portion of a liner outlet portion and a transition duct conduit inlet section of the combustor assembly illustrated in FIG. 1.

The inlet section 120B of the transition duct conduit 120A is fitted over the liner outlet portion 34B, see FIGS. 1 and 2. The outer diameter of the liner outlet portion 34B is preferably equal to or slightly smaller than an inner diameter of the inlet section 120B of the transition duct conduit 120A such that a slip fit occurs between the transition duct conduit inlet section 120B and the liner outlet portion 34B at ambient temperature. A low friction material or coating, such as chromium nitride, may be provided on one or both surfaces of the liner outlet portion 34B and the inlet section 120B of the transition duct conduit 120A, which surfaces are in engagement with one another. The liner outlet portion 34B may be provided with axially extending slits (not shown) so as to allow the liner outlet portion 34B to expand slightly during operation of the gas turbine engine to contact the transition duct conduit inlet section 120B. For example, the inner exit part 134 may have slits which are circumferentially spaced from slits provided in the outer exit part 136.

In the embodiment illustrated in FIGS. 1 and 2, no contoured spring clips are provided on the liner outlet portion as are commonly used in prior art combustor devices. Because contoured spring clips are not used in the embodiment illustrated in FIGS. 1 and 2, it is believed that less cold compressed air passes through an interface 135 between the liner outlet portion 34B and the inlet section 120B of the transition duct conduit 120A. Hence, it is believed that less cold compressed air enters the transition duct conduit 120A through the interface 135, thereby improving the emissions performance of the gas turbine engine.

Figure 3:
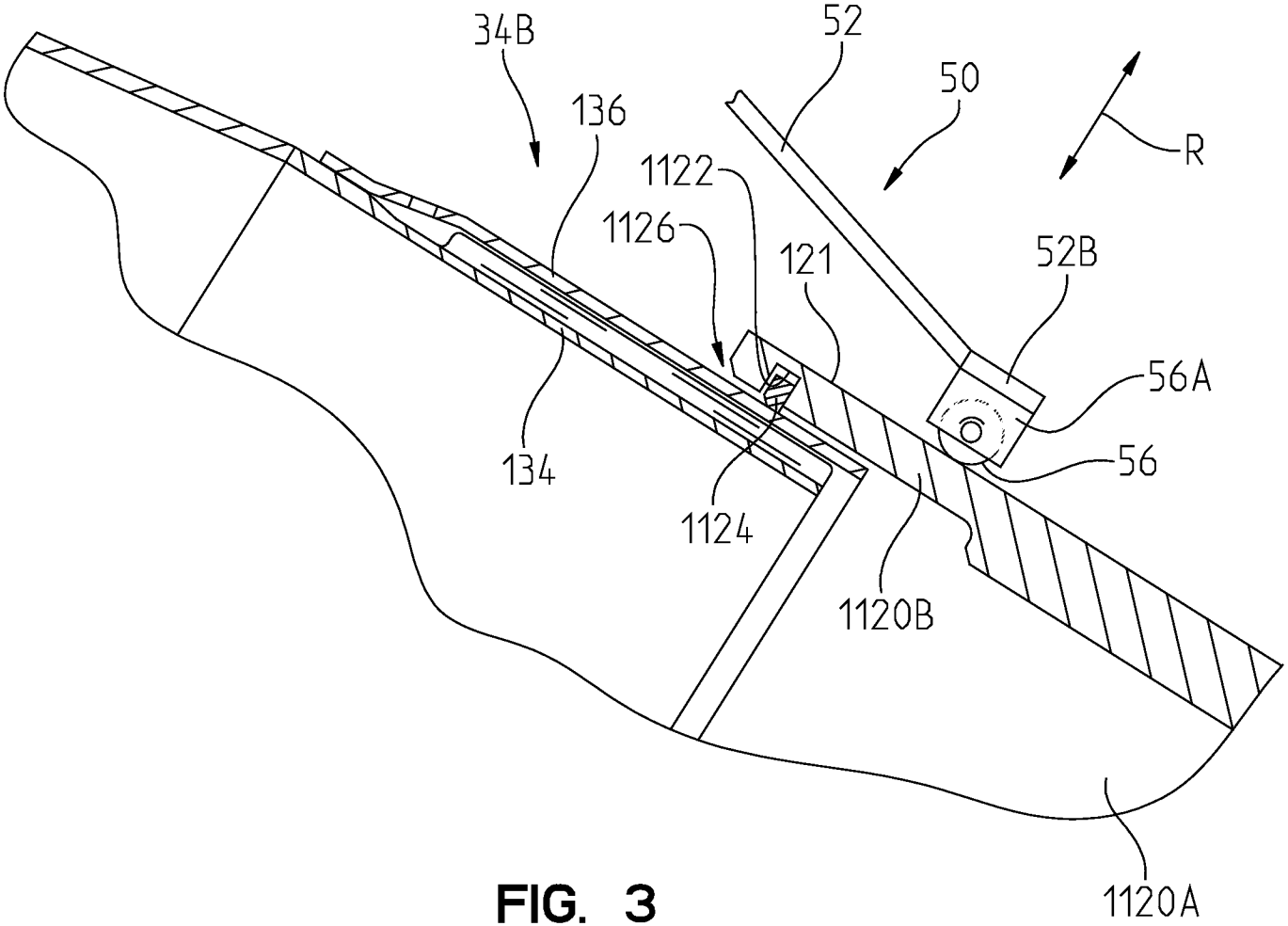
FIG. 3 is an enlarged cross sectional view of a portion of a liner outlet portion and a transition duct conduit inlet section of a combustor assembly constructed in accordance with a first alternative embodiment of the present invention.
Figure 6:
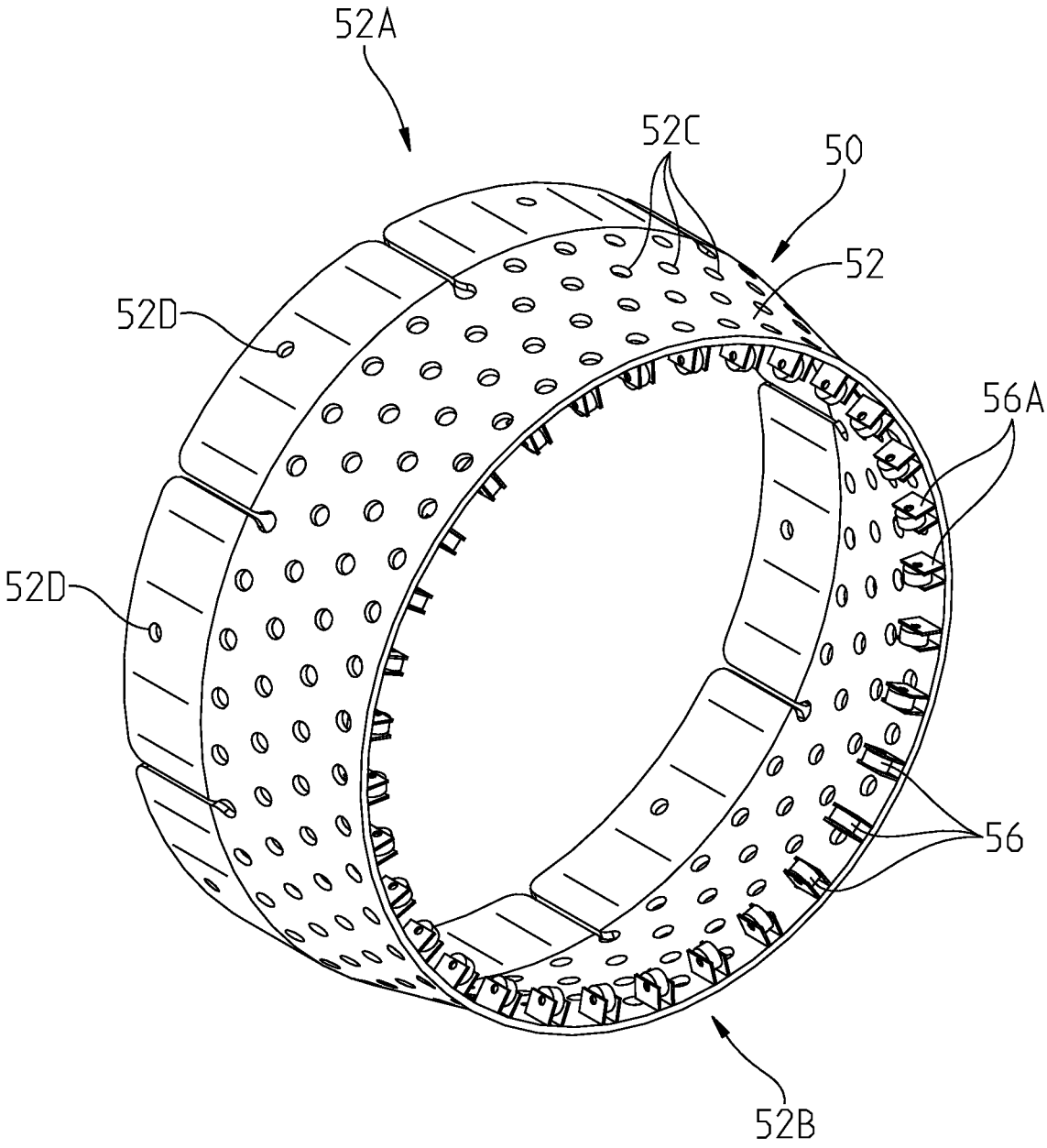
FIG. 6 is a perspective view of the flow conditioner of the combustor assembly illustrated in FIG. 1.

In the illustrated embodiment, the flow conditioner 50 comprises a perforated sleeve 52 having first and second ends 52A and 52B and a plurality of openings 52C, see FIGS. 1 and 6. The first end 52A of the sleeve 52 is fixedly coupled, such as by bolts 54, to a portal 12A of the outer casing 12. The bolts 54 pass through openings 52D provided in the sleeve first end 52A, see FIG. 6. In the embodiment illustrated in FIGS. 1, 2, 3 and 6, a plurality of roller bearings 56, each held by a bearing support 56A, extend circumferentially about an inner surface of the sleeve second end 52B. As illustrated in FIGS. 2 and 3, the bearings 56 engage an outer surface 121 of the transition duct conduit inlet section 120B such that the flow conditioner second end 52B functions to support the transition duct conduit inlet section 120B. The flow conditioner second end 52B provides sufficient support for the conduit inlet section 120B such that a separate support bracket extending between the main casing 12 and the conduit inlet section 120B is not provided or required in the illustrated embodiment. It is also noted that the bearings 56 allow the flow conditioner second end 52B and the transition duct conduit inlet section 120B to easily move relative to one another, such as in the axial direction A, as the flow conditioner second end 52B and transition duct conduit inlet section 120B thermally expand and contract during operational cycles of the gas turbine engine.

The flow conditioner 50 further functions to condition compressed air moving along paths, designated by arrows 300 in FIG. 1, from the compressor toward the burner assembly 38 to achieve a more uniform air distribution at the burner assembly 38. More specifically, the perforated flow conditioner 50 functions to cause a drop in pressure of the compressed air as it passes through the flow conditioner 50. Hence, the air flow through a generally annular gap G between the portal 12A/combustor casing 32 and the liner 34 and into liner inlet portion 34A is more evenly distributed, see FIG. 1.

In a first alternative embodiment illustrated in FIG. 3, where like elements are referenced by like reference numerals, the inlet section 1120B of the transition duct conduit 1120A is provided with a circumferentially extending slot or recess 1122 provided with a floating ring 1124. The ring 1124 may be formed from a hardened steel and functions to assist in sealing an interface 1126 between the liner outlet portion 34B and the inlet section 1120B of the transition duct conduit 1120A from cold compressed air so as to prevent or limit cold compressed air from passing through the interface 1126 and entering into the transition duct conduit 1120A. Because the ring 1124 can move or float within the recess 1122, it is capable of accommodating a small amount of misalignment or thermally induced relative movement in a radial direction between the liner outlet portion 34B and the inlet section 1120B of the transition duct conduit 1120A. The radial direction is indicated in FIG. 3 by arrow R. In this embodiment, the outer diameter of the liner outlet portion 34B may be slightly less than an inner diameter of the inlet section 1120B of the transition duct conduit 1120A.

Figure 4:
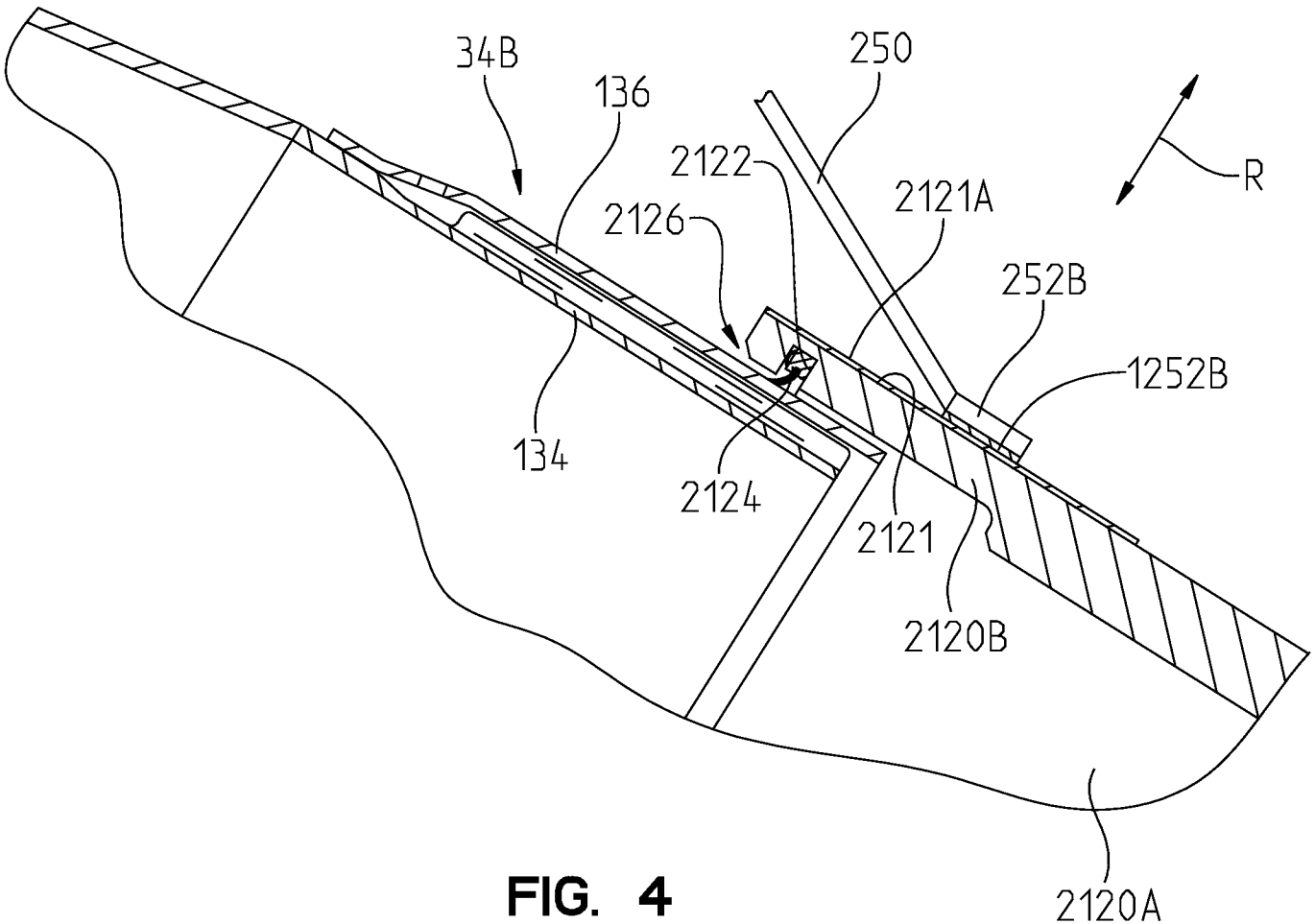
FIG. 4 is an enlarged cross sectional view of a portion of a liner outlet portion and a transition duct conduit inlet section of a combustor assembly constructed in accordance with a second alternative embodiment of the present invention.

In a second alternative embodiment illustrated in FIG. 4, where like elements are referenced by like reference numerals, the inlet section 2120B of the transition duct conduit 2120A is provided with a circumferentially extending slot or recess 2122 provided with a floating brush seal 2124. The brush seal 2124 may be formed from a high temperature capable, wear resistant material such as Haynes 230 and functions to assist in sealing an interface 2126 between the liner outlet portion 34B and the inlet section 2120B of the transition duct conduit 2120A from cold compressed air so as to prevent or limit cold compressed air from passing through the interface 2126 and entering into the transition duct conduit 2120A. Because the brush seal 2124 can move or float within the recess 2122, it is capable of accommodating a small amount of misalignment or thermally induced relative movement in a radial direction between the liner outlet portion 34B and the inlet section 2120B of the transition duct conduit 2120A. The radial direction is indicated in FIG. 4 by arrow R. In this embodiment, the outer diameter of the liner outlet portion 34B may be slightly less than an inner diameter of the inlet section 2120B of the transition duct conduit 2120A.

Further in the second alternative embodiment, the flow conditioner 250 comprises a perforated sleeve 250 having a second end 252B provided with a hard wear resistant coating 1252B, see FIG. 4. The outer surface 2121 of the transition duct conduit inlet section 2120B is also provided with a hard, wear resistant coating 2121A. The wear resistant coatings 1252B and 2121A are believed to allow the flow conditioner sleeve second end 252B and transition duct conduit inlet section 2120B to move smoothly relative to one another with reduced wear as the flow conditioner second end 252B and transition duct conduit inlet section 2120B thermally expand and contract during operational cycles of the gas turbine engine. The hard wear resistant coatings 1252B, 2121A may comprise a hard chromium carbide material. The wear resistant coatings 1252B, 2121A may comprise other wear resistant materials capable of withstanding the hot environment of a gas turbine engine and may be applied using application methods such as, but not limited to, air plasma spray (APS), plating, brazing and the like.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combustor assembly in a gas turbine engine comprising a main casing, said combustor assembly comprising: a combustor device coupled to the main casing comprising: a liner having inlet and outlet portions; a burner assembly positioned adjacent to said liner inlet portion; a transition duct comprising a conduit having inlet and outlet sections, said inlet section being of said transition duct conduit being associated with said liner outlet portion; and an annular flow conditioner attached at a first end to the main casing and engaging an outer surface of said inlet section of said transition duct conduit at a second end, said flow conditioner configured to increase the uniformity of an air distribution to said burner assembly, said flow conditioner being movable relative to said transition duct and configured to support said inlet section of said transition duct conduit such that a separate support bracket extending between the main casing and said inlet section of said transition duct conduit is not provided.

2. The combustor assembly as set out in claim 1, wherein said flow conditioner conditions compressed air moving toward said burner assembly to increase the uniformity of the air distribution to said burner assembly.

3. The combustor assembly as set out in claim 2, wherein said flow conditioner comprises a perforated sleeve having first and second ends, sleeve said first end being fixedly coupled to the main casing, and said sleeve second end and said transition duct conduit inlet section being movable relative to one another.

4. The combustor assembly as set out in claim 3, wherein said flow conditioner further comprises a roller bearing coupled to said sleeve second end for engaging an outer surface of said transition duct conduit inlet section.

5. The combustor assembly as set out in claim 3, wherein an inner surface of said sleeve second end and an outer surface of said transition duct conduit inlet section are provided with a wear resistant coating to allow said inner and outer surfaces to move smoothly relative to one another and prevent wear of said inner and outer surfaces.

6. The combustor assembly as set out in claim 1, wherein said liner outlet portion does not comprise radially contoured spring clips.

7. The combustor assembly as set out in claim 1, further comprising a floating ring provided in a slot formed in an inner surface of said transition duct conduit inlet section.

8. The combustor assembly as set out in claim 1, further comprising a brush seal associated with an inner surface of said transition duct conduit inlet section.

9. A combustor assembly in a gas turbine engine comprising a main casing, said combustor assembly comprising: a combustor device comprising: a liner having inlet and outlet portions; a burner assembly positioned adjacent said liner inlet portion; a transition duct comprising a conduit having inlet and outlet sections, said inlet section of said transition duct conduit being associated with said liner outlet portion, said liner outlet portion being devoid of radially contoured spring clips; and an annular flow conditioner attached at a first end to the main casing and engaging an outer surface of said inlet section of said transition duct conduit at a second end, said flow conditioner configured to increase the uniformity of an air distribution to said burner assembly, said flow conditioner being movable relative to said transition duct and configured to support said inlet section of said transition duct conduit such that a separate support bracket extending between the main casing and said inlet section of said transition duct conduit is not provided.

10. The combustor assembly as set out in claim 9, wherein said flow conditioner conditions compressed air moving toward said burner assembly to increase the uniformity of the air distribution to said burner assembly.

11. The combustor assembly as set out in claim 9, wherein said flow conditioner comprises a perforated sleeve having first and second ends, said sleeve first end being fixedly coupled to the main casing, and said sleeve second end and said transition duct conduit inlet section being capable of moving relative to one another.

12. The combustor assembly as set out in claim 11, wherein said flow conditioner further comprises a roller bearing coupled to said sleeve second end for engaging an outer surface of said transition duct conduit inlet section.

13. The combustor assembly as set out in claim 11, wherein an inner surface of said sleeve second end and an outer surface of said transition duct conduit inlet section are provided with a wear resistant coating to allow said inner and outer surfaces to move smoothly relative to one another and prevent wear of said inner and outer surfaces.

14. The combustor assembly as set out in claim 9, further comprising a floating ring provided in a slot formed in an inner surface of said transition duct conduit inlet section.

15. The combustor assembly as set out in claim 9, further comprising a brush seal associated with an inner surface of said transition duct conduit inlet section.

* * * * *